US006338018B1

(12) United States Patent
Baker

(10) Patent No.: US 6,338,018 B1
(45) Date of Patent: Jan. 8, 2002

(54) ENGINE COMMISSIONING

(75) Inventor: David A Baker, Wilson (AU)

(73) Assignees: Transcom NGVS Research Pty. Ltd., Herdsman; Orix Vehicle Technology Ptd. Ltd., Double Bay, both of (AU)

( * ) Notice: Subject to any disclaimer, the term of this patent is extended or adjusted under 35 U.S.C. 154(b) by 0 days.

(21) Appl. No.: 09/462,470

(22) PCT Filed: Jul. 10, 1998

(86) PCT No.: PCT/AU98/00539

§ 371 Date: May 3, 2000

§ 102(e) Date: May 3, 2000

(87) PCT Pub. No.: WO99/02835

PCT Pub. Date: Jan. 21, 1999

(30) Foreign Application Priority Data

Jul. 10, 1997 (AU) ..... PO 7828

(51) Int. Cl.[7] ..... F02D 41/26

(52) U.S. Cl. ..... 701/104; 701/115; 73/117.3

(58) Field of Search ..... 123/478, 480, 123/486; 73/117.3; 701/101, 102, 103, 104, 105, 106, 115; 711/103

(56) References Cited

U.S. PATENT DOCUMENTS 3,969,614 A 7/1976 Moyer et al. ..... 701/103
4,438,497 A 3/1984 Willis et al. ..... 701/105
4,903,210 A 2/1990 Akasu ..... 701/111
5,157,613 A 10/1992 Williams et al. ..... 701/111

FOREIGN PATENT DOCUMENTS

AU 35489/97 1/1998

*Primary Examiner*—Willis R. Wolfe
(74) *Attorney, Agent, or Firm*—Nixon & Vanderhye

(57) ABSTRACT

A method of commissioning an internal combustion engine controlled by an electronic engine control unit (ECU) is described. The method of commissioning includes an engine mapping function in which the engine is mapped at a combination of speeds and loads to build up a full set of engine operating parameters which are known collectively as the engine control set (ECS). The method includes defining a speed/load mapping table and generating a graphical display of a corresponding speed/load grid (20) having a plurality of cells arranged in a grid, each cell corresponding to a particular speed/load combination in the speed/load mapping table. The engine is driven as close as possible to a selected speed/load combination (24) and the value of a selected engine operating parameter is adjusted to obtain an optimum value at the selected speed/load combination. Each unmapped cell in the grid is displayed in a first visually distinct manner and each mapped cell is displayed in a second visually distinct manner. One cell (22) in the speed-load grid is displayed in a third visually distinct manner to indicate the engine's current operating position. The method of commissioning may optionally provide for automatic balancing of exhaust temperatures for each cylinder of the engine.

10 Claims, 5 Drawing Sheets

Speeds [RPM]

Loads [%]

| | 450 | 650 | 900 | 1100 | 1300 | 1500 | 1700 | 1900 | 2100 | 2300 |
|---|---|---|---|---|---|---|---|---|---|---|
| 0 | 2690 | 1735 | 1703 | 1818 | 2332 | 2200 | 2488 | 2534 | 2895 | 3052 |
| 10 | 3418 | 2449 | 2508 | 3389 | 4868 | 3659 | 3452 | 4711 | 4391 | 4500 |
| 20 | 3808 | 3528 | 3958 | 5169 | 6081 | 4889 | 4894 | 5867 | 5900 | 6000 |
| 30 | 4587 | 4654 | 5172 | 5934 | 7509 | 6812 | 6758 | 6296 | 6422 | 6500 |
| 40 | 5486 | 5842 | 6311 | 7800 | 9164 | 8415 | 8194 | 7814 | 8038 | 8000 |
| 50 | 6530 | 7111 | 7452 | 9090 | 10968 | 9767 | 9336 | 9422 | 9202 | 9300 |
| 60 | 7827 | 8219 | 8493 | 10234 | 12604 | 10720 | 11092 | 10924 | 10603 | 10600 |
| 70 | 9145 | 9925 | 9580 | 11278 | 13893 | 12839 | 12638 | 12540 | 12394 | 12300 |
| 80 | 10013 | 10052 | 10788 | 12543 | 14784 | 14589 | 15284 | 15000 | 14920 | 14000 |
| 90 | 10835 | 11492 | 11935 | 14017 | 16948 | 15654 | 16467 | 16400 | 16300 | 16000 |
| 100 | 12525 | 12755 | 13023 | 15471 | 16766 | 17198 | 17984 | 17850 | 17704 | 17704 |

Ok Cancel Help

Speeds [RPM]

Loads [%]

| | 450 | 650 | 900 | 1100 | 1300 | 1500 | 1700 | 1900 | 2100 | 2300 |
|---|---|---|---|---|---|---|---|---|---|---|
| 0 | 2690 | 1735 | 1703 | 1818 | 2332 | 2200 | 2488 | 2534 | 2895 | 3052 |
| 10 | 3418 | 2449 | 2508 | 3389 | 4868 | 3659 | 3452 | 4711 | 4391 | 4500 |
| 20 | 3808 | 3528 | 3958 | 5169 | 6081 | 4889 | 4894 | 5867 | 5900 | 6000 |
| 30 | 4587 | 4654 | 5172 | 5934 | 7509 | 6812 | 6758 | 6296 | 6422 | 6500 |
| 40 | 5486 | 5842 | 6311 | 7800 | 9164 | 8415 | 8194 | 7814 | 8038 | 8000 |
| 50 | 6530 | 7111 | 7452 | 9090 | 10968 | 9767 | 9336 | 9422 | 9202 | 9300 |
| 60 | 7827 | 8219 | 8493 | 10234 | 12604 | 10720 | 11092 | 10924 | 10603 | 10600 |
| 70 | 9145 | 9925 | 9580 | 11278 | 13893 | 12839 | 12638 | 12540 | 12394 | 12300 |
| 80 | 10013 | 10052 | 10788 | 12543 | 14784 | 14589 | 15284 | 15000 | 14920 | 14000 |
| 90 | 10835 | 11492 | 11935 | 14017 | 16948 | 15654 | 16467 | 16400 | 16300 | 16000 |
| 100 | 12525 | 12755 | 13023 | 15471 | 16766 | 17198 | 17984 | 17850 | 17704 | 17704 |

Ok

Cancel

Help

FIG. 2.

ECU logging session initiated at 8:56:03, 25/6/1996

| Time hh:mm:ss:ms | Eng Speed RPM | All Load % | BIOT ms | IOT1 ms | IOT2 ms | IOT3 ms | IOT4 ms | IOT5 ms | IOT6 ms |
|---|---|---|---|---|---|---|---|---|---|
| 00:00:00:000 | 1214 | 0.00 | 2.110 | 3.186 | 3.235 | 3.235 | 3.235 | 3.286 | 3.163 |
| 00:00:00:500 | 1214 | 0.00 | 2.110 | 3.188 | 3.237 | 3.237 | 3.237 | 3.288 | 3.165 |
| 00:00:01:000 | 1214 | 0.00 | 2.110 | 3.186 | 3.235 | 3.235 | 3.235 | 3.286 | 3.163 |
| 00:00:01:500 | 1214 | 0.00 | 2.110 | 3.186 | 3.234 | 3.234 | 3.234 | 3.286 | 3.162 |
| 00:00:02:000 | 1214 | 0.00 | 2.110 | 3.183 | 3.232 | 3.232 | 3.232 | 3.283 | 3.160 |
| 00:00:02:500 | 1214 | 0.00 | 2.110 | 3.190 | 3.238 | 3.238 | 3.238 | 3.290 | 3.166 |
| **00:00:03:000** | **1214** | **0.00** | **2.110** | **3.188** | **3.237** | **3.237** | **3.237** | **3.288** | **3.165** |
| **00:00:03:500** | **1214** | **0.00** | **2.110** | **3.190** | **3.239** | **3.239** | **3.239** | **3.290** | **3.167** |
| **00:00:04:000** | **1214** | **0.00** | **2.110** | **3.190** | **3.238** | **3.238** | **3.238** | **3.290** | **3.166** |
| 00:00:04:500 | 1214 | 0.00 | 2.110 | 3.188 | 3.237 | 3.237 | 3.237 | 3.288 | 3.165 |
| 00:00:05:000 | 1214 | 0.00 | 2.110 | 3.188 | 3.237 | 3.237 | 3.237 | 3.288 | 3.165 |
| 00:00:05:500 | 1214 | 0.00 | 2.110 | 3.186 | 3.234 | 3.234 | 3.234 | 3.286 | 3.162 |
| 00:00:06:000 | 1214 | 0.00 | 2.110 | 3.188 | 3.237 | 3.237 | 3.237 | 3.288 | 3.165 |
| **00:00:06:500** | **1214** | **0.00** | **2.110** | **3.186** | **3.234** | **3.234** | **3.234** | **3.286** | **3.162** |
| **00:00:07:000** | **1214** | **0.00** | **2.110** | **3.186** | **3.235** | **3.235** | **3.235** | **3.286** | **3.163** |
| **00:00:07:500** | **1214** | **0.00** | **2.110** | **3.186** | **3.234** | **3.234** | **3.234** | **3.286** | **3.162** |
| 00:00:08:000 | 1214 | 0.00 | 2.110 | 3.186 | 3.235 | 3.235 | 3.235 | 3.286 | 3.163 |
| 00:00:08:500 | 1214 | 0.00 | 2.110 | 3.189 | 3.238 | 3.238 | 3.238 | 3.289 | 3.166 |
| 00:00:09:000 | 1214 | 0.00 | 2.110 | 3.188 | 3.237 | 3.237 | 3.237 | 3.288 | 3.165 |
| 00:00:09:500 | 1214 | 0.00 | 2.110 | 3.188 | 3.237 | 3.237 | 3.237 | 3.288 | 3.165 |

ECU logging session ended at 8:56:13, 25/6/1996

FIG. 5.

ENGINE COMMISSIONING

FIELD OF THE INVENTION

The present invention relates to a method of commissioning an internal combustion engine controlled by an electronic engine control unit and relates particularly, but not exclusively, to an engine mapping function incorporated in the method of commissioning.

BACKGROUND TO THE INVENTION

Co-pending application Ser. No. 09/269,791 filed Apr. 1, 1999 describes an improved engine control unit (ECU) for controlling the operation of a gas fuelled internal combustion engine. The disclosure of Ser. No. 09/269,791 is incorporated herein by reference.

The ECU uses various engine operating parameters stored in non-volatile memory to control the operation of the engine. These parameters may be programmed through a serial port by an external device. The engine operating parameters are collectively known as the engine control set (ECS). The ECS includes numerous parameters defined and stored in table form, including the Engine Speed Table, Startup Spark Advance Angle Table, Startup Injector On Time Table, Water Jacket Temperature Throttle Limit Table, Manifold Air Temperature Throttle Limit Table, Exhaust Temperature Throttle Limit Table, Individual Injector Switch On Time Table, Individual Injector Flow Rate Table and the MVP Area Table, most of which are self-explanatory. These parameters are stored in the ECU memory during commissioning of the ECU following engine mapping.

As part of the process of commissioning an engine, it is mapped at a combination of speeds and loads to build up the full ECS that gives the engine its required performance. This covers steady state torque output, maximum speed governing and emissions, whilst observing the original equipment manufacturer's (OEM's) limits on thermal loads and maximum cylinder pressure. During this process the ECU automatically compensates for gas pressure and temperature variations that inevitably occur such that the injector on-time (IOT) to be recorded is referenced to standard gas pressure and temperature. Similarly, ignition timing is modified according to the manifold air temperature such that the recorded values are augmented if the air temperature is higher than the set reference temperature of 25° C. and conversely if the air temperature is lower than the reference. When mapping is finished all engine operating parameters are downloaded into the ECU.

SUMMARY OF THE INVENTION

The present invention was developed with a view to providing a method of commissioning an ECU and performing various executive functions such as engine mapping.

According to the present invention there is provided a method of commissioning an internal combustion engine controlled by an electronic engine control unit, the method comprising:

mapping a selected engine operating parameter over a range of engine speeds and loads so as to obtain optimum values for said selected engine operating parameter for different speeds/load combinations, said mapping process involving the steps of:

(a) defining a speed/load mapping table and generating a graphical display of a corresponding speed/load grid comprising a plurality of cells arranged in a grid, each cell corresponding to a particular speed/load combination in the speed/load mapping table, each unmapped cell in the grid being displayed in a first visually distinct manner and each mapped cell being displayed in a second visually distinct manner;

(b) selecting an unmapped cell in said speed/load grid for mapping;

(c) driving the engine as close as possible to the selected speed/load combination;

(d) displaying the current value of said selected engine operating parameter;

(e) adjusting the value of said selected engine operating parameter to thereby obtain an optimum value for said engine operating parameter at said selected speed/load combination;

(f) saving the optimum value at said selected speed/load combination in the speed/load mapping table; and, (g) repeating steps (b) to (f) until the selected engine operating parameter has been mapped for all desired cells in the speed/load grid.

Preferably one cell in the speed/load grid is displayed in a third visually distinct manner to indicate the engine's current operating position. Preferably said step of selecting an unmapped cell for mapping (step (b)) includes displaying said selected unmapped cell in a fourth visually distinct manner.

Advantageously said selected engine operating parameter is one of a plurality of selected engine operating parameters which may be mapped simultaneously using the speed/load grid. In a preferred embodiment said plurality of selected engine operating parameters are manifold valve position (MVP), injector on time (IOT) and spark advance angle (SAA). Step (c) in the method may be performed by controlling the engine throttle and/or by manipulating the values for MVP, IOT and/or SAA, and/or setting the dynamometer speed.

Advantageously the graphical display of said speed/load grid is displayed as part of an engine mapping dialog box, said engine mapping dialog box including a read-only display of the current value of said selected engine operating parameter, a scroll bar for changing an offset value of said selected engine operating parameter and a read-only display of the resulting value of said engine operating parameter which is the sum of the current value and the offset value, wherein step (e), adjusting the value of said selected operating parameter, involves scrolling to an appropriate offset value using said scroll bar to obtain the optimum resulting value for said selected engine operating parameter.

Preferably said engine mapping dialog box also includes a plurality of IOT offset spin boxes, one for each of the engine's injectors, and wherein the method of commissioning further comprises applying an individual IOT offset to a base IOT offset for any one or more of the injectors.

Advantageously the method of commissioning may optionally provide for automatic balancing of exhaust temperatures for each cylinder of the engine, wherein said step of automatically balancing involves:

logging exhaust temperatures for each cylinder of the engine;

averaging the exhaust temperature values across all cylinders to obtain an average exhaust temperature value;

calculating a deviation of the exhaust temperature value for each cylinder from said average exhaust temperature value; and, adjusting the individual IOT offsets for each injector simultaneously based on said respective deviations whereby, in use, the exhaust temperatures for each cylinder can be brought closer to the average exhaust temperature value.

BRIEF DESCRIPTION OF THE DRAWINGS

In order to facilitate a more comprehensive understanding of the nature of the invention, a preferred embodiment of the method of commissioning an internal combustion engine will now be described in detail, by way of example only, with reference to the accompanying drawings in which:

FIG. 2 illustrates an example of an engine operating parameter 3-D Table employed by the engine commissioning software;

DETAILED DESCRIPTION OF PREFERRED EMBODIMENT

Figure 1:
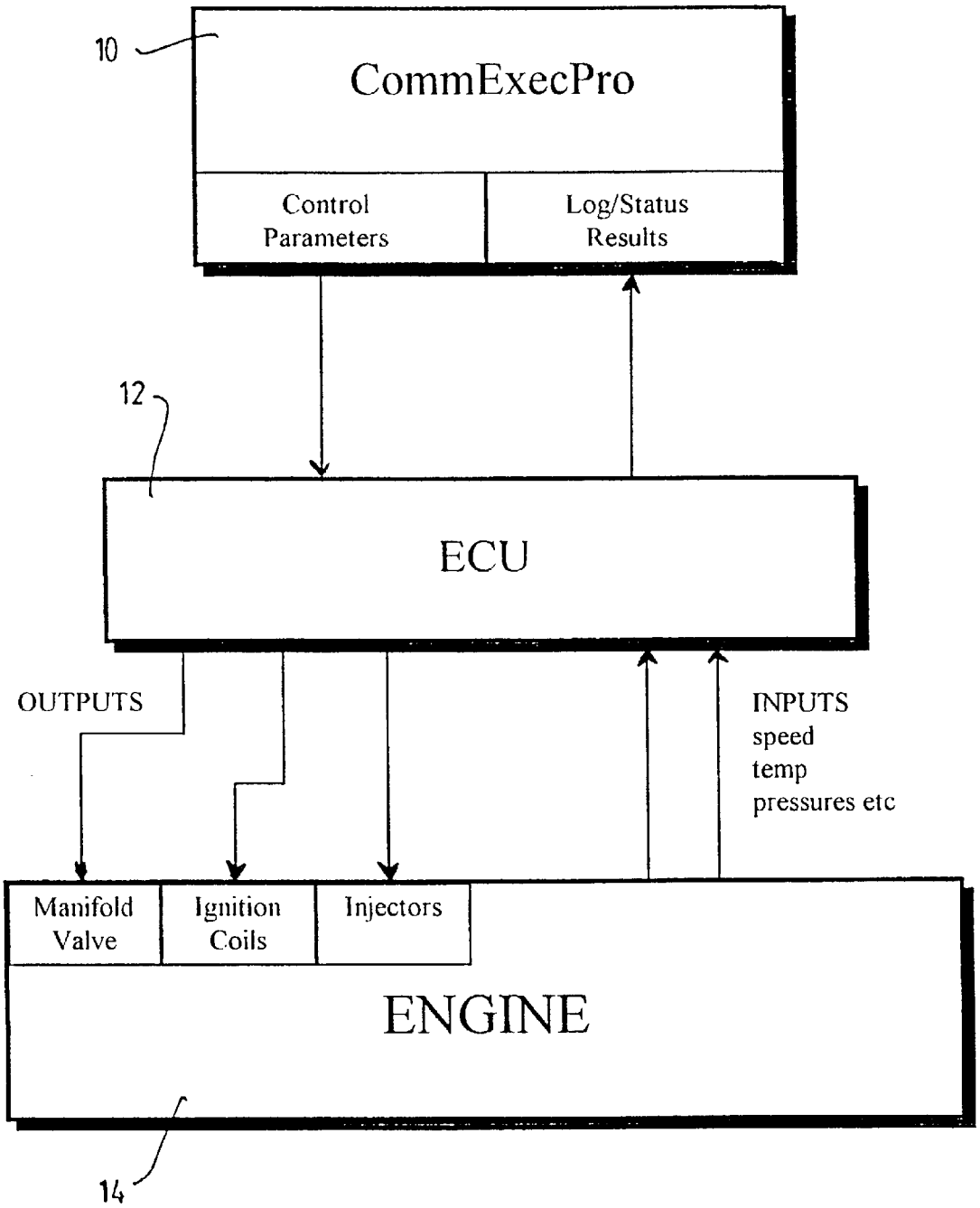
FIG. 1 is a block diagram illustrating the inter-relationship between an ECU, a preferred embodiment of the engine commissioning software and an engine.

A preferred embodiment of the method of commissioning is implemented using a computer software program called CommExecPro, developed for commissioning the ECU described in PCT/AU97/00658 and for performing various executive functions. CommExecPro is a Microsoft Windows application which allows the user to control and monitor a six cylinder engine via the ECU. The CommExecPro software is used to program the ECS during commissioning, and may also read the ECS that the ECU is currently using. CommExecPro may also request operational logging for monitoring of engine performance. The CommExecPro software communicates with the ECU via a three wire RS-232 serial interface. A proprietary communications protocol has been defined to allow the CommExecPro and ECU to communicate via the RS-232 communications interface. FIG. 1 illustrates in block diagram form an overview of the interrelationship between CommExecPro 10, the ECU 12 and the engine 14.

The software in ECU 12 supports six types of 3-D tables, namely, a Base Injector On Time (IOT) 3-D table, an Injector On Time (IOT) Offset 3-D table, a Manifold Valve Position (MVP) 3-D table, a Spark Advance Angle (SAA) 3-D table, a Desired Torque 3-D table and a Desired Air Density (DAD) 3-D table. CommExecPro likewise defines these six types of 3-D tables which allow a user to enter optimum values for the various engine speed/engine load combinations.

FIG. 2 illustrates a dialog box generated and displayed by CommExecPro, which allows the user to set values in the Base IOT 3-D Table. These base IOT values are then saved by CommExecPro for downloading to the ECU following the process of engine mapping. The Base IOT values are set in ps for the various engine speed/engine load combinations. The valid range of values is 0 $\mu$s to 30,000 $\mu$s, with a resolution of 1 $\mu$s. If the user presses the F4 key, all selected cells will be incremented by 10 $\mu$s. If the user presses the F5 key, all selected cells will be decremented by 10 $\mu$s.

Figure 4:
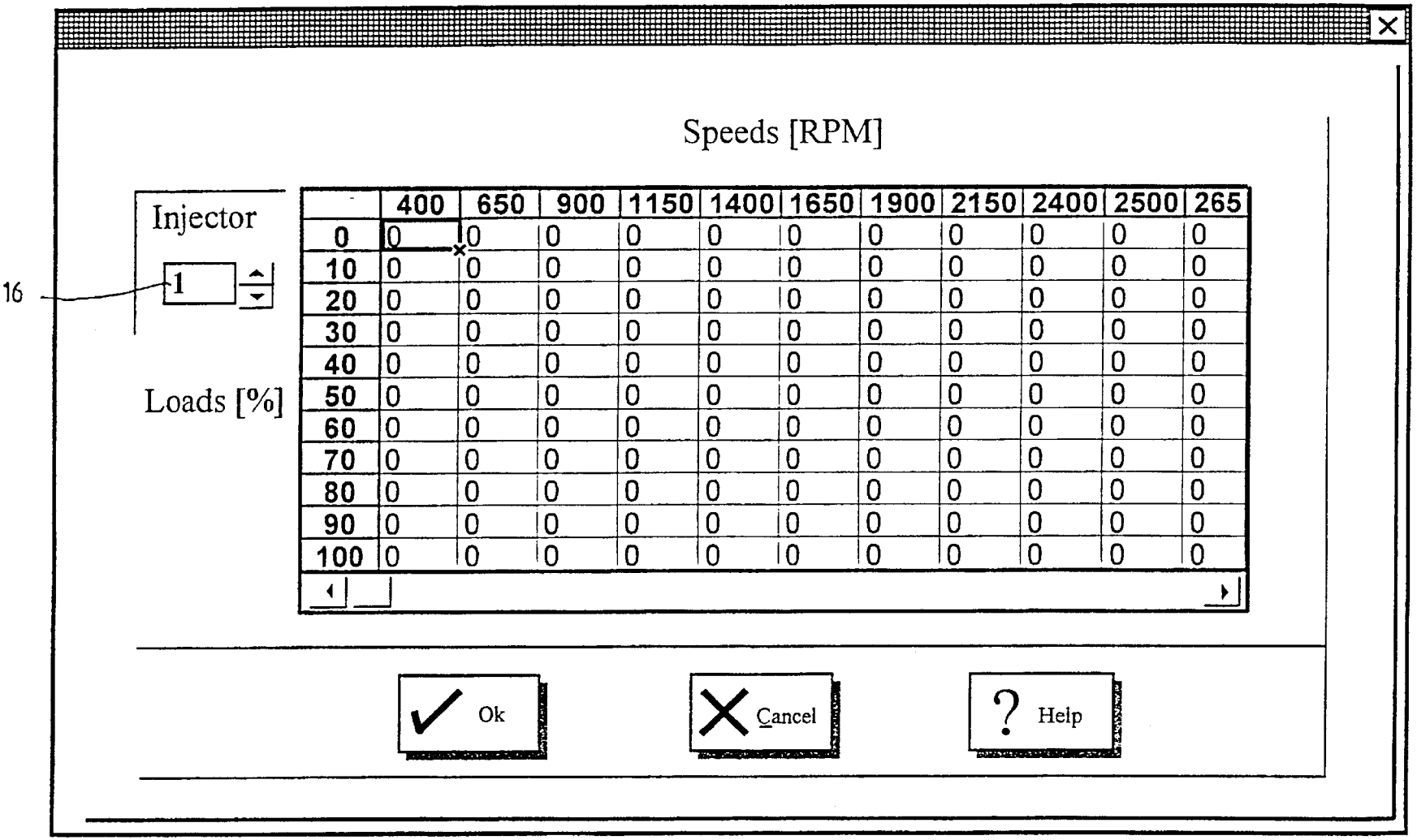
FIG. 4 illustrates another example of an engine operating parameter 3-D Table employed by the engine commissioning software; and, FIG. 5 illustrates a logging window in which logged parameters are displayed by the engine commissioning software.

CommExecPro generates a similar dialog box for each of the other five types of 3-D tables employed by the ECU. For example, FIG. 4 illustrates the dialog box for the IOT Offset 3-D tables which allows the user to set values in the IOT Offset 3-D tables. The spin box control 16 (edit box and scroll bar) allows the user to display the IOT Offset 3-D table for the injector shown in the edit box. For a six cylinder engine there will be six IOT Offset 3-D tables, one for each injector. The valid range of values which may be entered for the lOT Offsets depends on the corresponding Base IOT for the specified injector. Each of the 3-D tables created in CommExecPro can be downloaded to the ECU via a proprietary communications protocol.

The process of engine mapping using CommExecPro will now be described with reference to FIG. 3. Engine mapping is the process of optimising an engine and programming certain engine operating parameters for the ECU. These operating parameters are stored in the form of 3-D tables. The programming of these parameters is done via the Settings Engine Mapping command. This command causes an engine mapping dialog box to be displayed, which controls the communication of these key engine operating parameters to the ECU which, in turn, controls the engine accordingly.

Figure 3:
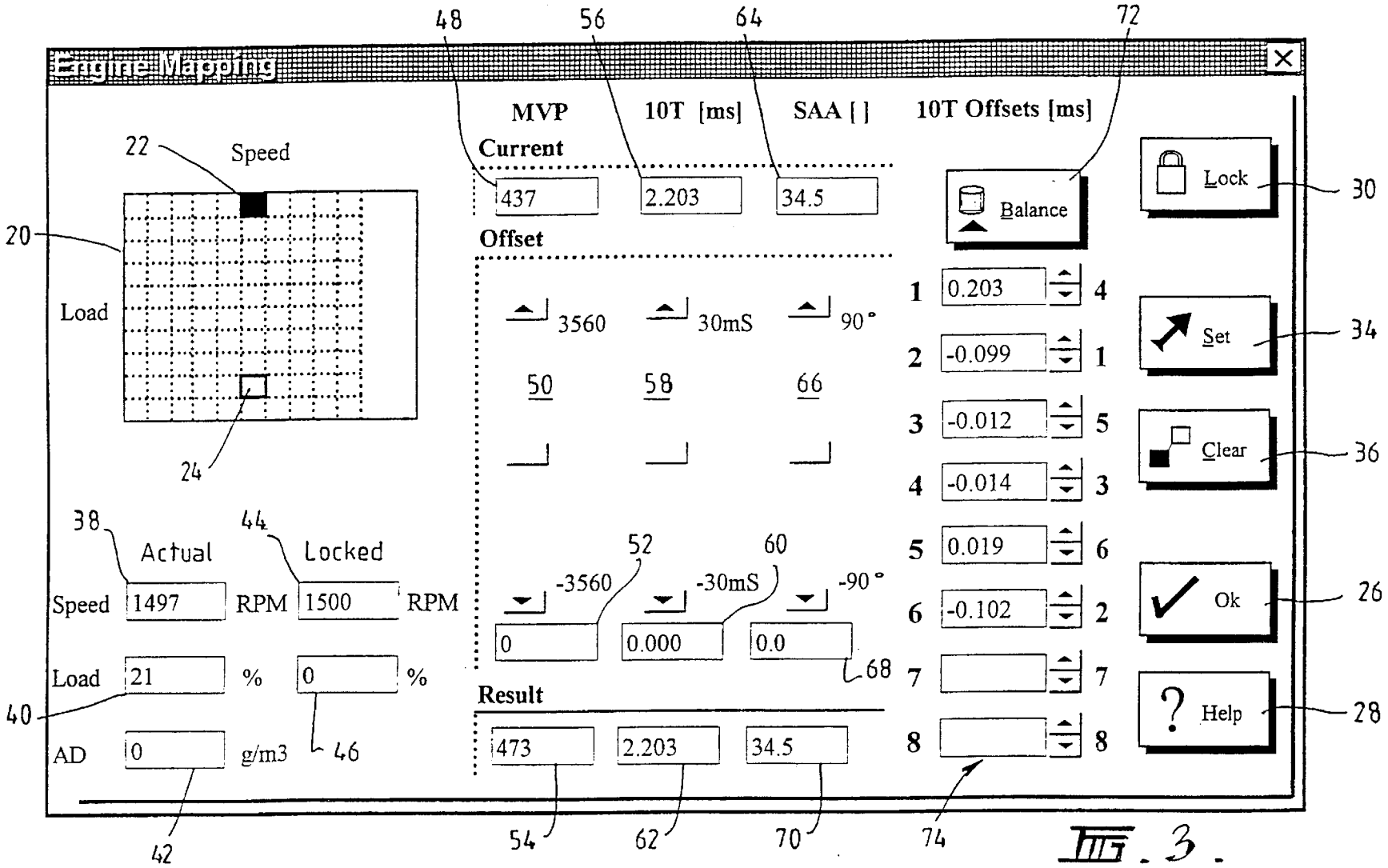
FIG. 3 illustrates an Engine Mapping dialog box employed by the engine commissioning software.

As can be clearly seen in FIG. 3, the engine mapping dialog box incorporates a Speed vs Load status grid 20 which comprises a plurality of cells arranged in a grid, each cell corresponding to a particular speed/load combination in one of the speed/load mapping 3-D tables. Each unmapped cell in the grid 20 is displayed in a first visually distinct manner, for example, a first colour (white), and each mapped cell is displayed in a second visually distinct manner, for example a second colour (green). One cell 22 in the speed vs load status grid 20 is displayed in a third visually distinct manner, for example in the colour red, to indicate the speed/load combination nearest to the engine's current operating position. When selecting an unmapped cell for mapping, the selected unmapped cell is preferably displayed in a fourth visually distinct manner, in this case as a thick outline cell 24.

The engine mapping dialog box contains a number of controls which are described below.

OK button 26

This button allows the user to dismiss the dialog box. This is the default button for this dialog box.

Help button 28

This button allows the user to display context sensitive help for this dialog box.

Lock button 30

This button allows the user to lock the position currently displayed in the Speed vs Load status grid 20. MVP, SAA and IOT may then be manipulated independent of each other, i.e. manipulation of MVP does not cause a change in SAA or IOT. When this button is pressed, the Lock button is hidden and the Unlock button is displayed in its place.

Unlock button 30

This button allows the user to unlock the position currently displayed in the Speed vs Load status grid 20. MVP, SAA and IOT are dependent on each other, i.e. manipulation of one may cause a change in the others. When this button is pressed, the Unlock button is hidden and the Lock button is displayed in its place.

Set button 34

This button allows the user to save the values in the three Result edit boxes to the currently selected cell 24 (thick outline) in the corresponding 3-D table.

Clear button 36

This button allows the user to clear all mapped grid squares (green) to unmapped squares (white).

Speed vs Load status grid 20

This grid control illustrates the current status of the engine mapping process. Each cell in the grid corresponds to a specific engine speed/load combination for which the engine is to be optimised by modifying the IOT, MVP and SAA parameters. A white coloured cell is empty, i.e. the engine has not been optimised for the corresponding engine speed/load combination. A green coloured cell implies that the engine parameters have been set for the corresponding engine speed/load combination. The red coloured cell, of which there is always exactly one, indicates the engine's current operating position. The thick outlined cell is the cell that is currently selected for optimisation. When the user presses the Set button 34 the outlined cell indicates the cell position in the 3-D tables that the Result values will be saved to.

Actual engine speed edit box 38

This edit box shows the actual engine speed. This is a read-only edit box.

Actual engine load edit box 40

This edit box shows the actual engine load. This is a read-only edit box.

Actual Air Density edit box 42

This edit box shows the actual air density. This is a read-only edit box.

Locked engine speed edit box 44

This edit box shows the current locked engine speed. This is a read-only edit box and corresponds to the red cell 22 in the Speed vs Load status grid 20.

Locked engine load edit box 46

This edit box shows the current locked engine load. This is a read-only edit box and corresponds to the red cell 22 in the Speed vs Load status grid 20.

Current Manifold Valve Position edit box 48

This edit box shows the base manifold valve position currently being used by the ECU. This is a read-only edit box. This value may be interpolated.

Manifold Valve Position offset scrollbar 50

This scrollbar indicates graphically the manifold valve position offset. The range of values for the scrollbar is from −mvs to +mvs. Where mvs is the number of manifold valve steps. The position of the scrollbar is reflected numerically by the Manifold Valve Position offset edit box. The scrollbar can be controlled by the usual mouse interface or via the keyboard. For fine control the <Insert> key is used to increase the manifold valve position offset and the <Delete> key is used to decrease it. For coarse control the <Ctrl> key is pressed together with the <Insert> or <Delete> key to provide large increments or decrements in the manifold valve position.

Manifold Valve Position offset edit box 52

This edit box reflects the position of the Manifold Valve Position offset scrollbar. This edit box is read-only.

Result Manifold Valve Position edit box 54

This edit box shows the resulting manifold valve position which is the current manifold valve position plus the offset. This is a read-only edit box.

Current Injector On Time edit box 56

This edit box shows the uncompensated base injector on time currently being used by the ECU. This is a read-only edit box. This value may be interpolated.

Injector On Time offset scrollbar 58

This scrollbar indicates graphically the injector on time offset. The range of values for the scrollbar is from −30 ms to +30 ms. The position of the scrollbar is reflected numerically by the Injector On Time offset edit box. The scrollbar can be controlled by the usual mouse interface or via the keyboard. For fine control the <Home> key is used to increase the current injector on time and the <End> key is used to decrease it. For coarse control the <Ctrl> key is pressed together with the <Home> or <End> key to provide large increments or decrements in the current injector on time.

Injector On Time offset edit box 60

This edit box reflects the position of the Injector On Time offset scrollbar. This edit box is read-only.

Result Injector On Time edit box 62

This edit box shows the resulting injector on time which is the current injector on time plus the offset. This is a read-only edit box.

Current Spark Advance Angle edit box 64

This edit box shows the uncompensated base spark advance angle currently being used by the ECU. This is a read-only edit box. This value may be interpolated.

Spark Advance Angle offset scrollbar 66

This scrollbar indicates graphically the spark advance angle offset. The range of values for the scrollbar is from −90° to +90°. The position of the scrollbar is reflected numerically by the Spark Advance Angle offset edit box. The scrollbar can be controlled by the usual mouse interface or via the keyboard. For fine control the <Page Up> key is used to increase the spark advance angle and the <Page Down> key is used to decrease it. For coarse control the <Ctrl> key is pressed together with the <Page Up> or <Page Down> key to provide large increments or decrements in the spark advance angle.

Spark Advance Angle offset edit box 68

This edit box reflects the position of the Spark Advance Angle offset scrollbar. This edit box is read-only.

Result Spark Advance Angle edit box 70

This edit box shows the resulting spark advance angle which is the current spark advance angle plus the offset. This is a read-only edit box.

Balance button 72

This button allows the user to easily balance or even-out cylinder exhaust temperatures. This is achieved by logging the exhaust temperatures for each cylinder. If these parameters are not logged the Balance button will have no effect.

IOT Offset spin boxes 74

There is one of these spin boxes for each of the engine's injectors. Each one allows the user to apply an offset to the Result Base Injector On Time, but only for its corresponding injector.

When the engine mapping dialog box is first displayed, the engine is in an unlocked state, and having gone through startup will come to some stable point of operation. The red coloured cell 22 in the speed versus load status grid 20 will illustrate roughly at which speed/load point the engine has settled. The actual speed and load edit boxes 38, 40 will provide a more exact view of this. It is important to note that the ECU 12 must be in control of an engine 14 for engine mapping to be possible. This implies that the ECS on the ECU must be consistent with those on CommExecPro and that the ECS on the ECU are valid. If these conditions are not met, engine mapping will not be allowed to proceed. Generally the process of engine mapping consists of the following steps:

Firstly, the engine dynamometer is set to limit the speed to that which the user wishes to optimise. In the engine mapping dialog box, an engine speed/load combination is selected by driving the engine to the appropriate cell in the speed/load grid 20. If automatic cell tracking is enabled, the selected cell for mapping 24 (outlined cell) follows the current cell 22 where the engine is running (red cell). If automatic cell tracking is disabled, the user must manually select a cell for mapping by clicking twice on the desired cell. The engine may be driven to the appropriate cell for mapping by manipulating the throttle of the engine and/or by manipulating the three scroll bars 50, 58, 66 which correspond to offsets to MVP, SAA and IOT as well as the spin boxes 74 which correspond to the individual IOT offsets for each injector. Engine load and speed are used to index and interpolate the 3-D table look-up values for MVP, SAA and IOT. In addition to using the spin boxes to change the individual IOT offset one at a time, the balance button 72 can be used to automatically adjust the individual IOT offsets simultaneously in order to balance them. Automatic cylinder balancing will be described in greater detail below.

When the engine is close to the appropriate cell for mapping in the grid 20, the user can press the lock button 30 if desired. This means that MVP, SAA and IOT base values are locked but can be manipulated independently, via the scroll bars 50, 58, 66 in the engine mapping dialog box, and the current grid cell 22 will remain the same. In the locked mode the user attempts to match the actual speed and load to the locked speed and load as displayed in the locked speed and load edit boxes 44, 46. Manipulation of the MVP, SAA and IOT base values can also be performed in the unlocked mode in order to optimise the values at the selected speed/load combination. In either case, when the optimum values are obtained, the user can press the set button 34 and the result values, as displayed in edit boxes 54, 62 and 70, will be saved to the appropriate cell in the respective 3-D tables. The user then repeats the above steps until the selected engine operating parameters have been optimised for all engine speed/load combinations.

Optimisation of engine operating parameters requires the user to monitor numerous other engine performance parameters such as exhaust emissions, torque (power), temperatures, fuel flow characteristics, etc. A separate application has been developed called TIDAS (Transcom International Data Acquisition System) for converting the raw data from various analogue sensors into a digital format for display and analysis of the engine performance parameters. CommExecPro has a facility which allows the user to analyse a data file output by the TIDAS application via the production of "parameter maps", and also provides for the generation and application of recommendations for adjustments to various ECS tables.

CommExecPro also provides a facility for automatically balancing or evening-out cylinder exhaust temperatures. This is achieved by logging the exhaust temperatures for each cylinder using data obtained from TIDAS. The exhaust temperature values are then averaged across all cylinders to obtain an average exhaust temperature value. Deviations of the exhaust temperature value for each cylinder from the average exhaust temperature value are then calculated and used to adjust the individual IOT offsets for each injector simultaneously. The algorithm employed by CommExecPro to calculate the adjusted individual IOT offset for each cylinder is as follows:

$$IOTOffAdj_n = -(IOT_n \times IOTOffFactor/100) \times exht_dev_n \quad (1)$$

$$IOTOffAdj_n = \min(\max(IOTOffAdj_n - IOTOffAdj\max), IOTOffAdj\max) \quad (2)$$

where the following definitions apply:

$exht_n$ is the exhaust temperature of cylinder n in ° C., $exht_{ave}$ is the average of all the cylinder exhaust temperatures in ° C., $exht_dev_n$ is the deviation from $exht_{ave}$ of the exhaust temperature of cylinder n in ° C., BIOT is the current Base Injector On Time being used by the ECU in μs, $IOTOff_n$ is the current Individual Injector On Time Offset for cylinder n being used by the ECU in μs, IOTOffFactor is a scaling factor which allows control over how 'severe' the adjustments to each $IOTOff_n$ will be. This is measured in % of IOT/° C.

$IOT_n$ is an intermediate Injector On Time value which can take two different forms as shown below in equation (4).

IOTOffAdjMax is the maximum time by which $IOTOff_n$ may be adjusted at one time in μs.

$IOTOffAdj_n$ is the adjusted Individual Injector On Time Offset for cylinder n to be used by the ECU after the cylinder balancing algorithm has been calculated in μs, For n=1 to no. of engine cylinders, $$exht_dev_n = exht_n - exht_{ave}$$

If user chooses not to use current IOT Offsets in balancing calculation, $$IOT_n = BIOT \quad (3)$$

If user chooses to use current IOT offsets in balancing calculation, $$IOT_n = BIOT + IOTOff_n \quad (4)$$

The provision of individual injector offsets means that variances between cylinders due to dynamic air flow and residence effects in the manifold as well as variances in the individual injectors can be compensated for. Each injector can be given either a positive or negative offset value to balance the cylinders of the engine. This feature allows the engine to operate as lean as possible to reduce $NO_x$ emissions without incurring misfire limitations that would otherwise occur.

To obtain feedback from an engine, the user can employ CommExecPro to initiate an engine logging session. During an engine logging session, the user still has access to some other features of CommExecPro. When the user initiates an engine logging session, the values of selected parameters are displayed in a logging window. FIG. 5 illustrates a typical logging window. The logged values are updated at regular intervals and updated values are displayed on a new line each time so that previous values remain visible to the user. This enables the user to determine trends in the variation of logged parameters during a logging session.

Before initiating an engine logging session, the user can select which engine parameters are to be logged. This is called the log specification and can currently contain up to eighty different engine parameters. However, only twenty-five of these parameters may be visible at any one time. If a parameter is not visible, it is not displayed in the logging window and is not saved to the logging file. However, it is stored internally for other uses. The heading for each parameter is displayed at the top of the logging window and includes the appropriate units. These headings cannot be scrolled. However, the actual logged parameter values and all other logging window contents can be scrolled, both vertically and horizontally.

Logging parameters may be logged from the ECU and/or from TIDAS. TIDAS parameters are retrieved using the dynamic data exchange (DDE) protocol. CommExecPro can act as a DDE server and client. Any DDE client application may request or ask CommExecPro to advise it of any change to the values or units for each individual logging parameter. As a DDE client, CommExecPro can extract the value of any logged parameter from the TIDAS application via a "hot link". Once this link is established TIDAS will communicate any changes to the parameters value to the CommExecPro. The user may log any of these parameters in the logging window just like any other logging parameter from the ECU, since the source of the parameter is transparent.

Now that a preferred embodiment of the method of commissioning an engine has been described in detail, it will be event to person's skilled in the relevant arts that numerous variations and modifications may be made, in addition to those already described, without departing from the basic inventive concepts. All such variations and modifications are to be considered within the scope of the present invention, the nature of which is to be determined from the foregoing description and the appended claims.

What is claimed is:

1. A method of commissioning an internal combustion engine controlled by an electronic engine control unit, the method comprising:

mapping a selected engine operating parameter over a range of engine speeds and loads so as to obtain optimum values for said selected engine operating parameter for different speeds/load combinations, said mapping process involving the steps of:

(a) defining a speed/load mapping table and generating a graphical display of a corresponding speed/load grid comprising a plurality of cells arranged in a grid, each cell corresponding to a particular speed/load combination in the speed/load mapping table, each unmapped cell in the grid being displayed in a first visually distinct manner and each mapped cell being displayed in a second visually distinct manner;

(b) selecting an unmapped cell in said speed/load grid for mapping and displaying said selected unmapped cell in a fourth visually distinct manner;

(c) driving the engine as close as possible to the selected speed/load combination;

(d) displaying the current value of said selected engine operating parameter;

(e) adjusting the value of said selected engine operating parameter to thereby obtain an optimum value for said engine operating parameter at said selected speed/load combination;

(f) saving the optimum value at said selected speed/load combination in the speed/load mapping table; and, (g) repeating steps (b) to (f) until the selected engine operating parameter has been mapped for all desired cells in the speed/load grid.

2. A method of commissioning an internal combustion engine as defined in claim 1, wherein one cell in the speed/load grid is displayed in a third visually distinct manner to indicate the engine's current operating position.

3. A method of commissioning an internal combustion engine as defined in claim 1, wherein said selected engine operating parameter is one of a plurality of selected engine operating parameters which may be mapped simultaneously using the speed/load grid.

4. A method of commissioning an internal combustion engine as defined in claim 3, wherein said plurality of selected engine operating parameters are manifold valve position (MVP), injector on time (IOT) and spark advance angle (SAA).

5. A method of commissioning an internal combustion engine as defined in claim 4, wherein Step (c) in the method may be performed by controlling the engine throttle and/or by manipulating the values for MVP, IOT and/or SAA, and/or setting the dynamometer speed.

6. A method of commissioning an internal combustion engine as defined in claim 1, wherein the graphical display of said speed/load grid is displayed as part of an engine mapping dialog box, said engine mapping dialog box including a read-only display of the current value of said selected engine operating parameter.

7. A method of commissioning an internal combustion engine as defined in claim 6, wherein said engine mapping dialog box further includes a scroll bar for changing an offset value of said selected engine operating parameter and a read-only display of the resulting value of said engine operating parameter which is the sum of the current value and the offset value, wherein step (e), adjusting the value of said selected operating parameter, involves scrolling to an appropriate offset value using said scroll bar to obtain the optimum resulting value for said selected engine operating parameter.

8. A method of commissioning an internal combustion engine as defined in claim 7, wherein said engine mapping dialog box also includes a plurality of IOT offset spin boxes, one for each of the engine's injectors, and wherein the method of commissioning further comprises applying an individual IOT offset to a base IOT offset for any one or more of the injectors.

9. A method of commissioning an internal combustion engine as defined in claim 8, the method further comprising a step of automatic balancing of exhaust temperatures for each cylinder of the engine, wherein said step of automatically balancing involves:

logging exhaust temperatures for each cylinder of the engine;

averaging the exhaust temperature values across all cylinders to obtain an average exhaust temperature value;

calculating a deviation of the exhaust temperature value for each cylinder from said average exhaust temperature value; and, adjusting the individual IOT offsets for each injector simultaneously based on said respective deviations whereby, in use, the exhaust temperatures for each cylinder can be brought closer to the average exhaust temperature value.

10. A method of commissioning an internal combustion engine as defined in claim 10, wherein an adjusted individual IOT offset for each cylinder is calculated using the following algorithm:

$$IOTOffAdj_n = -(IOT_n \times IOTOff\text{Factor}/100) \times \text{i exht_}dev_n)$$

$$IOTOffAdj_n = \min(\max(IOTOffAdj_n, -IOTOffAdj\max), IOTOffAdjmax)$$

where the following definitions apply:

$exht_n$ is the exhaust temperature of cylinder n in ° C., $exht_{ave}$ is the average of all the cylinder exhaust temperatures in ° C., $exht_dev_n$ is the deviation from $exht_{ave}$ of the exhaust temperature of cylinder n in ° C., $IOTOff_n$ is the current Individual Injector On Time Offset for cylinder n being used by the ECU in μs, IOTOffFactor is a scaling factor which allows control over how 'severe' the adjustments to each $IOTOff_n$ will be; this is measured in % of IOT/° C., $IOT_n$ is an intermediate Injector On Time value, IOTOffAdjMax is the maximum time by which $IOTOff_n$ may be adjusted at one time in μs, $IOTOffAdj_n$ is the adjusted Individual Injector On Time Offset for cylinder n to be used by the ECU after the cylinder balancing algorithm has been calculated in μs, For n=1 to no. of engine cylinders, $$exht_dev_n = exht_n = exht_{ave}.$$

* * * * *